US005870957A

United States Patent [19]

Müller

[11] Patent Number: 5,870,957

[45] Date of Patent: Feb. 16, 1999

[54] METHOD OF STARTING-UP/RESTARTING CONTINUOUS PRINTING IN PRINTING

[75] Inventor: Joachim Müller, Pullach, Germany

[73] Assignee: MAN Roland Druckmaschinen AG, Germany

[21] Appl. No.: 935,757

[22] Filed: Sep. 23, 1997

[30] Foreign Application Priority Data

Sep. 24, 1996 [DE] Germany ..... 196 39 134.2

[51] Int. Cl.[6] ..... B41F 13/24

[52] U.S. Cl. ..... 101/484; 101/144; 101/232; 271/10.13

[58] Field of Search ..... 101/483, 484, 101/485, 248, 141, 142, 144, 145, 216, 217, 218, 232, 183; 271/10.02, 90, 8.1, 112, 10.13

[56] References Cited

U.S. PATENT DOCUMENTS

| | | | |
|---|---|---|---|
| 3,460,473 | 8/1969 | Norton . | |
| 3,960,079 | 6/1976 | Capetti | 101/232 |
| 5,103,733 | 4/1992 | Drapatsky et al. | 101/485 |
| 5,584,244 | 12/1996 | Klingler . | |
| 5,606,913 | 3/1997 | Kowalewski | 101/183 |
| 5,626,077 | 5/1997 | Muller . | |
| 5,649,483 | 7/1997 | Mack et al. | 101/232 |
| 5,699,736 | 12/1997 | Muller et al. | 101/232 |

FOREIGN PATENT DOCUMENTS

| | | |
|---|---|---|
| 1 611 226 | 12/1970 | Germany . |
| 44 07 631 C1 | 10/1995 | Germany . |
| 195 05 560 | 8/1996 | Germany . |

*Primary Examiner*—Eugene Eickholt
*Attorney, Agent, or Firm*—Leydig, Voit & Mayer, Ltd.

[57] ABSTRACT

A method is disclosed for starting-up/restarting continuous printing in a sheet-processing printing machine where the sheets to be printed are fed from a feeder stack connected to the printing machine via a switchable clutch, the feeder assembly is cut-in at a basic speed, and the printing machine is run-up to a continuous printing speed. According to the invention, the time for starting the running up of the printing machine from the basic speed to the continuous production speed is a function of the number of machine revolutions necessary to convey a first sheet from the feeder stack to a predetermined position inside the printing machine such that the first sheet reaches the predetermined position inside the printing machine at the same time or after the production speed is reached. The object of the invention is to reduce the number of rejects that occur during the starting-up/restarting of the printing machine to the largest extent possible.

5 Claims, 4 Drawing Sheets

METHOD OF STARTING-UP/RESTARTING CONTINUOUS PRINTING IN PRINTING

FIELD OF THE INVENTION

This invention relates generally to methods for controlling printing machines, and more particularly, to a method for starting-up/restarting the printing process on a sheet-processing printing machine.

BACKGROUND OF THE INVENTION

In sheet-fed printing machines, the sheets to be printed are removed from the top of a feeder stack, conveyed over a conveyor table to a feeder rest and aligned on a feeder lay. Sheets properly resting on the feeder lay are gripped by a pre-gripper and conveyed into the first printing unit where printing commences. The starting-up/restarting of continuous printing requires various steps to properly initiate this printing process. Procedurally, the process of starting-up/restarting of continuous printing is performed by cutting-in a feeder assembly at a basic rotational speed and simultaneously cutting-in sheet removal actuators. The basic rotational speed is illustratively 5,000 sheets per hour. Cutting-in is achieved by activating switchable clutches coupled to the drive of the printing machine which initiate the removal and conveyance of sheets.

The printing machine executes a number of revolutions before the first sheet reaches the feeder rest since several sheets rest on the conveyor table at one time. As sheets are conveyed on the conveyor table between the feeder stack and the first printing unit in an imbricated fashion, they travel at a speed slower than the speed of the sheets traveling within the printing machine. Once in the printing unit, the sheets are accelerated to the continuous printing speed.

During the run-up operation a certain number of reject sheets are produced. Rejects occur for various reasons including inadequate ink saturation in the first sheets printed due to the fact that the ink/damping solution equilibrium is not established prior to the first sheets entering the printing unit. Rejects also occur on account of drive torsion and mackling which results when sheets are accelerated to the continuous printing speed from a resting position after waiting for the print machine to complete the run-up process.

Disclosed in U.S. Pat. No. 5,584,244 (and corresponding German Patent DE 4 407 631 C1) is a method for starting the production run on a sheet-processing printing machine. According to that method, the feeder assembly is cut-in at a basic rotational speed while the sheet removal actuators are disengaged. After the printing machine is run-up to the continuous printing speed, the paper supply is cut-in causing removal of sheets from the stack and conveyance into the printing machine. This method reduces the large number of reject sheets incurred during the start-up process by ensuring that a first sheet entering the printing machine for printing is printed at the continuous printing speed.

Disclosed in U.S. Pat. No. 5,626,077 (and corresponding German Patent DE 195 05 560 A1) is a method for controlling sheet feed. According to that method, a controller is utilized to determine the presence of double or misfed sheets as the sheets are removed from a sheet stack in a feeder unit. Upon the detection of a double or misfed sheet, the controller, through actuating devices in the machine, shuts down various printing machine functions such that the sheets ahead of the double or misfed sheet complete the printing process and the machine ceases operating precisely at the point where the double or misfed sheet reaches the feeder rest. This method avoids the situation where sheets located on the conveyor table are discarded after detection of a double or misfed sheet. This method also turns off the ink feed and damping solution feed such that the sheets still printing, after detection of a double or misfed sheet, pick up the ink from the rubber blanket and printing plate. Thus, over-inking of the first sheet is avoided when printing resumes.

Disclosed in DE 195 10 082 C2 (corresponding to U.S. application Ser. No. 08/618,786, which is assigned to the same assignee as that of the present application) is a method and apparatus for controlling the sheet supply in a sheet processing printing machine. According to that method, sheets are conveyed across a conveyor table to a feeder rest in a printing unit. When the first sheet hits the predetermined position in the printing machine, the sheet feed process is stopped and a process implementing predamping and preinking in a first printing unit is started. After the predamping and preinking process is complete, the sheet feed process is restarted and a first sheet enters the printing zone. This method also reduces reject sheets by ensuring that a first sheet entering the printing machine for printing receives the optimal ink and is not over or under saturated. A disadvantage associated with this method is that the sheet feed process is halted while waiting for the preinking and predamping process to complete.

SUMMARY OF THE INVENTION

The present invention is directed to a method for starting-up/restarting continuous printing in a sheet fed offset printing machine. The primary objective of the present invention is to provide a method for coordinating the cutting-in of a feeder assembly, cutting-in of separately actuable members causing the removal of sheets from a feeder stack, and running up of a printing machine to a pre-programmed continuous production printing speed in such a way that discards occurring during the start-up/restart of the printing machine due to drive torsion and mackling during sheet acceleration in the printing machine are reduced to the largest extent possible. It is another objective of the invention to reduce discards of poor quality prints which result from inking differences due to over and under saturation of ink on the inking blanket.

According to a preferred embodiment of the invention, the method comprises cutting-in the feeder assembly and the separately actuable members causing removal of the sheets from the stack. The printing machine is then run-up to a higher rotational speed which is a pre-programmed continuous production printing speed. It is a feature of the present invention that the time for starting the running up of the printing machine, from the basic speed to the production speed, is set as a function of the number of machine revolutions necessary to convey a first sheet from the feeder stack to a predetermined position inside the printing machine such that the first sheet reaches the predetermined position at the same time or after the production speed is reached. The first sheet to enter the printing machine after start-up/restart is, thus, printed at the production speed.

As a result of the fact that the invention prescribes that the printing machine is operating at the pre-programmed continuous production printing speed prior to sheets being fed through the printing machine, the invention ensures that sheets removed from the feeder stack are conveyed directly in the printing unit and are not halted while awaiting run-up of the printing machine. The invention further ensures that the printing machine is given adequate time to complete the pre-inking and pre-damping process so that the ink/damping solution equilibrium is reached by allocating sufficient time for run-up of the printing machine. As a result, the first sheets entering the printing machine, including thin and sensitive printing sheets, are perfectly printed.

Other features and advantages of the invention will be more readily apparent from the following detailed description of the preferred embodiment of the invention when taken in conjunction with the accompanying drawings wherein:

DETAILED DESCRIPTION OF THE PREFERRED EMBODIMENTS

Figure 1:
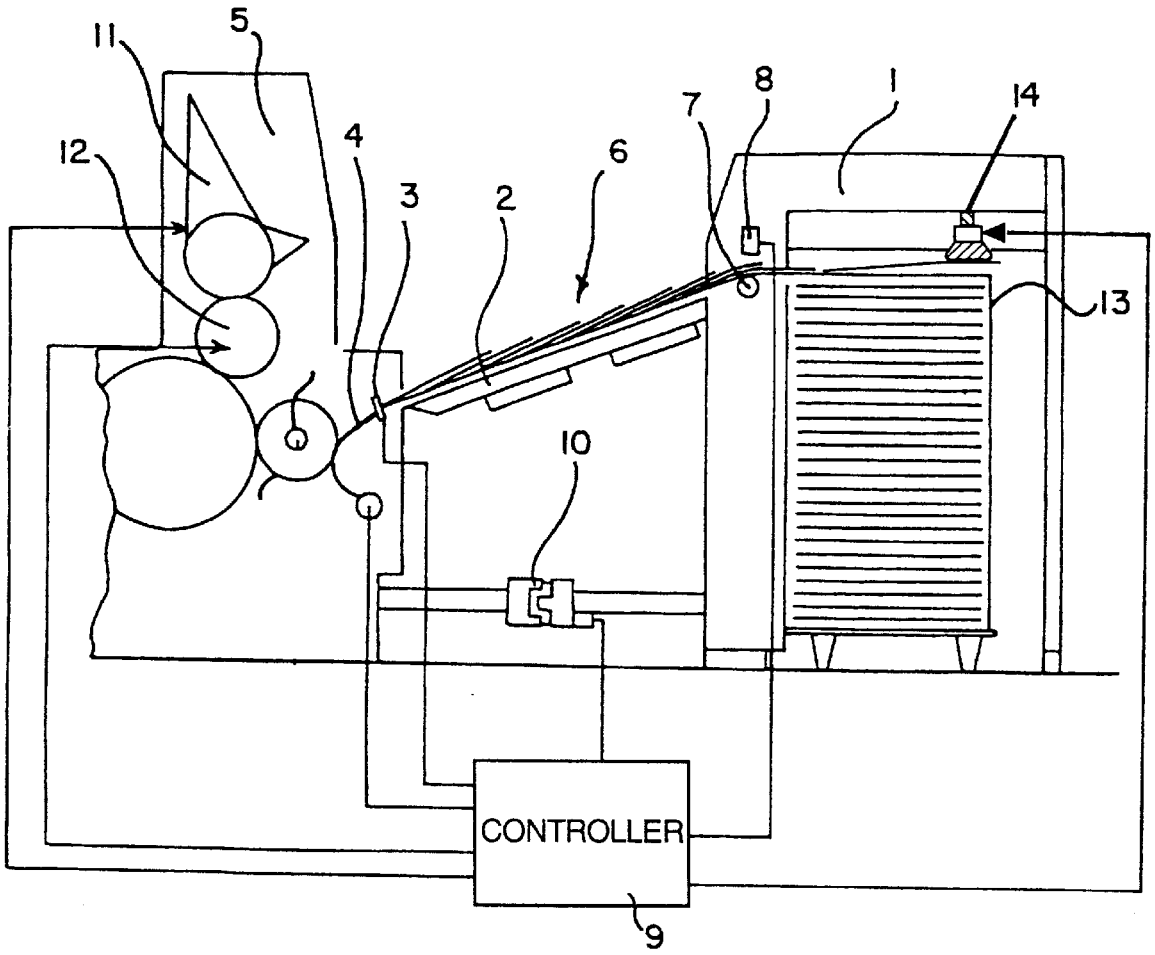
FIG. 1 is a prior art drawing showing a diagrammatic representation of a sheet-fed offset printing machine including a feeder and a first printing unit of a feeder.

A method for starting-up/restarting continuous printing in accordance with the present invention may be utilized in sheet-fed offset printing machines as described in U.S. Pat. No. 5,626,077. Turning to the drawings, FIG. 1 illustrates an exemplary sheet-fed offset printing machine including a feeder unit 1 and a first printing unit 5. In sheet-fed offset printing machines, sheets to be printed are removed from the top side of a feeder stack 13 in the feeder unit 1 and conveyed over a transport roller 7 onto a conveyor table 2. The sheets removed from the top side of the feeder stack 13 are separated from feeder stack 13 by a pull sucker 14. The sheets 6 on top of the conveyor table 2 are then conveyed in an imbricated fashion to a feeder rest 3. The number of sheets 6 on the conveyor table 2 is based on the format length of the sheets, the degree of imbrication, and the distance between the transport roller 7 and the feeder rest 3. This calculation is made by the controller 9. In the exemplary embodiment illustrated in FIG. 1, there are six sheets between the transport roller 7 and the feeder rest 3.

After the first sheet is removed from the feeder stack 13, the transport roller 7 executes the number of revolutions necessary to place the required number of sheets on the conveyor table 2, such that, the first sheet reaches the feeder rest 3. After an alignment process to enable correct positioning of the sheets 6, the first sheet at the feeder rest 3 is seized by a pre-gripper 4 and accelerated to the continuous printing speed $V_D$ of the printing unit 5. Once inside the printing unit, ink is transferred to the sheet.

In conventional printing machines, dampening solution is first applied to a printing plate mounted on a printing cylinder to facilitate transfer of the ink. The ink is then applied to the printing plate via an inking unit 11. The printing plate, however, does not directly contact the sheets. Rather, the ink is transferred to a rubber blanket mounted on a blanket cylinder 12 and is applied to the sheets as the sheets are conveyed over a back-pressure cylinder which cooperates with the blanket cylinder 12.

Figure 2:
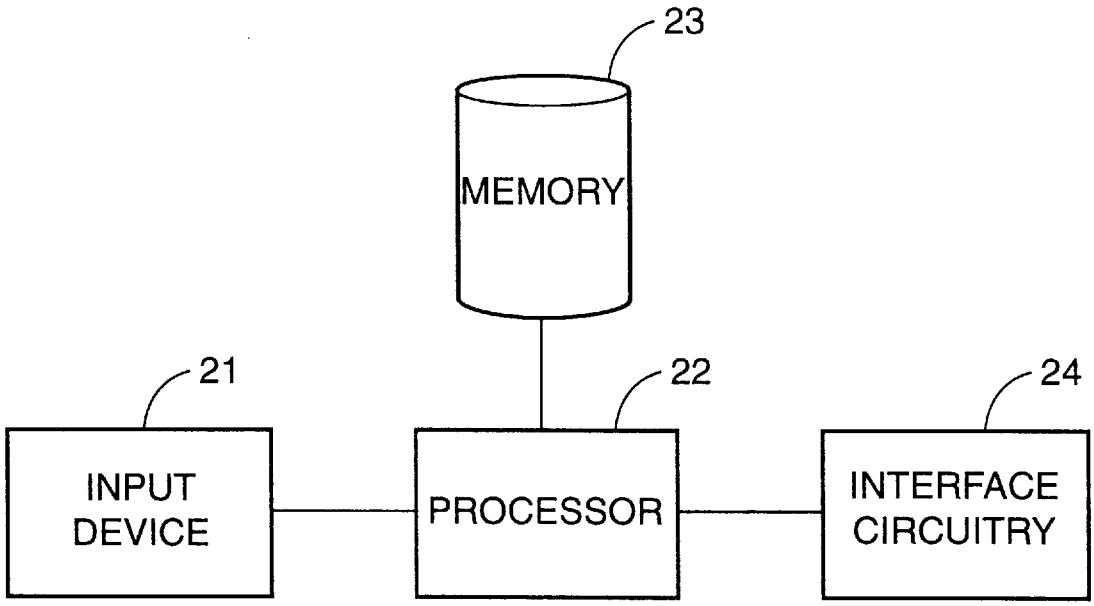
FIG. 2 is a block diagram of a controller for a sheet-fed offset printing machine.

The starting-up/restarting of continuous printing in a sheet-fed offset printing machine is implemented by a controller 9. The controller 9 may comprise a hardware controller, a software controller, or a combination hardware/software controller. In the preferred embodiment, the controller 9 comprises a hardware/software controller. FIG. 2 is a block diagram representation of an exemplary controller 9. The exemplary controller 9 comprises a processor 22, memory 23, an input device 21, and interface circuitry 24. As shown, data is input through an input device 21, preferably through a computer terminal. The input device 21 is connected to the processor 22 and comprises the means to input relevant input data, for example, the format length of the sheets. Once received, the input data is stored in the computer memory 23. The memory 23 comprises the software to implement the above-described sheet feed process. The processor 22 processes the input data as instructed by the software and outputs instructions to the interface circuitry. The interface circuitry 24 comprises all the circuits for the communication of information and commands between the controller 9 and the devices to which the controller 9 is connected.

Returning to FIG. 1, the controller 9 is connected to the feeder unit 1 through a feeder clutch 10. The feeder clutch 10 engages and disengages the feeder unit 1. This allows the feeder unit 1 to be mechanically started and stopped while the printing units continue to run or the printing machine continues to turn which is necessary in the event of misfed sheets, double sheets or other disturbances in the sheet travel. Essentially, the feeder clutch engages and disengages the sheet control 8 and the pull sucker 14, such that, sheets start or cease to be fed over the transport roller 7 onto the conveyor table 2. When the feeder unit 1 is stopped, the sheets 6 remaining on the conveyor table 3 and the sheets in the printing machine complete the printing process. When the feeder unit 1 is started-up/restarted, the feeder clutch 10 engages the feeder unit 1 and sheets are cut-in. The feeder clutch 10, therefore, is designed as an indexing clutch which connects the controller 9 and the feeder unit 1 in the correct phase. Due to the maximum strength of the clutch parts, the feeder can only be cut-in at up to a maximum basic speed $V_M$ of the printing machine as described in FIGS. 4 and 5. The sheets 6, therefore, travel at a transport speed slower than the continuous printing speed $V_D$ of the sheets within the printing machine.

The starting-up/restarting of continuous printing in a sheet-fed offset printing machine is performed by cutting-in the feeder assembly by means of engaging the feeder clutch 10 at the basic speed $V_G$ or maximum basic speed $V_M$ and simultaneously or sequentially cutting-in the sheet removal by switching on the pull sucker 14 and the transport roller 7. According to the invention, the first sheet to be printed reaches the predetermined position in the printing machine only after or at the same time the printing machine reaches the programmed continuous production printing speed $V_D$. The predetermined position is either the feeder rest 3 or the first printing zone, not depicted, of the printing machine.

Figure 3:
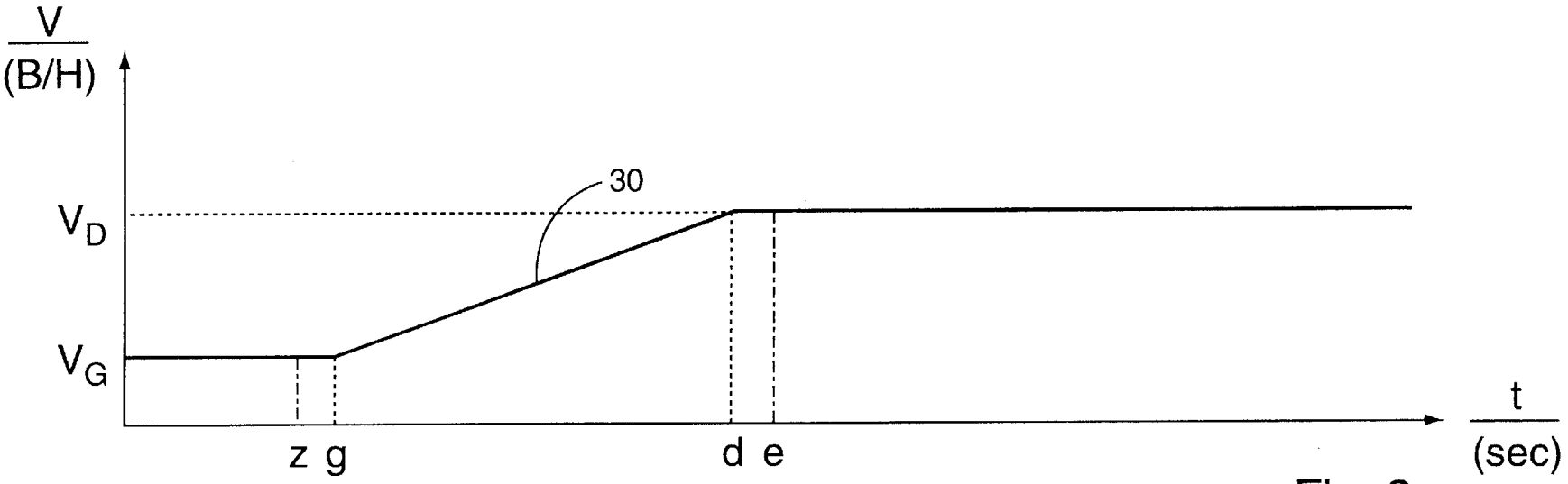
FIG. 3 is a graph, having a time axis as the abscissa and a rotation velocity axis as the ordinate, showing the variation of the printing speed during the running-up operation.
Figure 4:
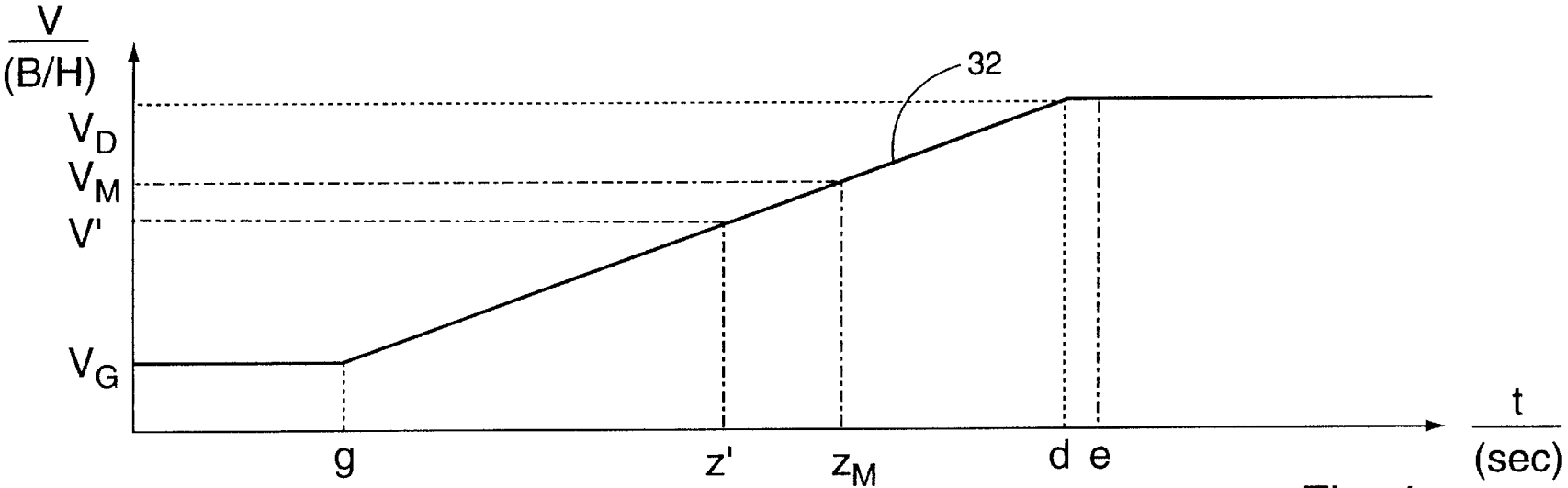
FIG. 4 is a similar graph to FIG. 3 showing an alternative method according to the invention.
Figure 5:
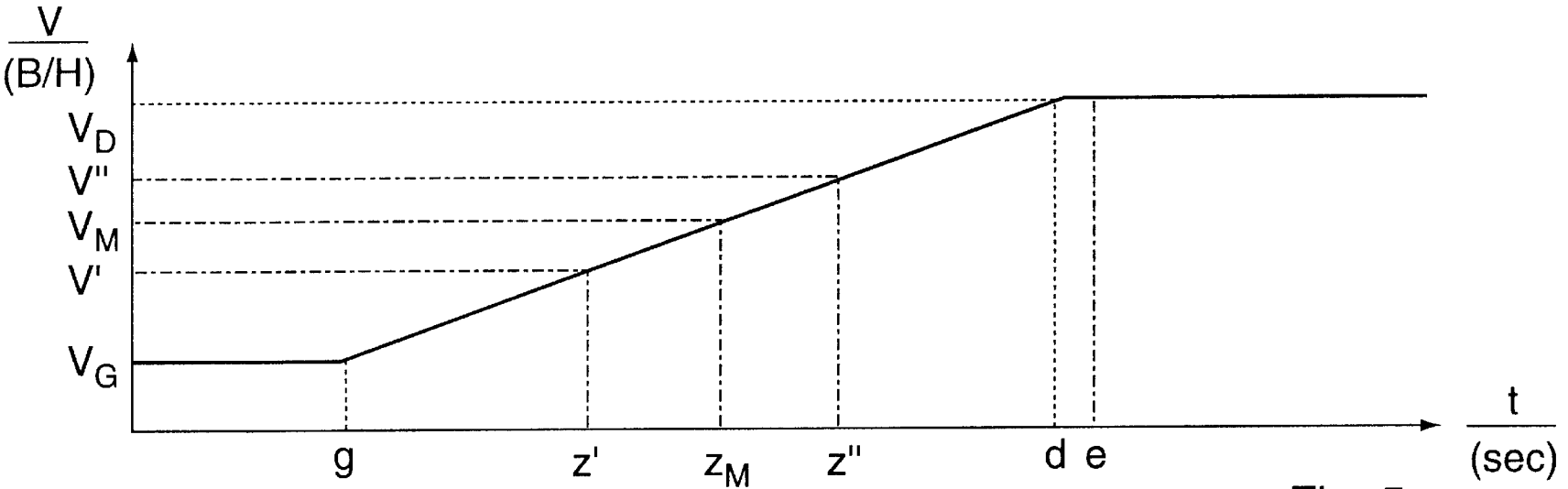
FIG. 5 is a similar graph to FIG. 4 showing another alternative method according to the invention.

FIGS. 3, 4 and 5 graphically illustrate three embodiments for carrying out the inventive method. Such methods will be performed on a sheet-fed press as in FIG. 1 including a controller 9 as shown in FIG. 2. In FIGS. 3, 4 and 5, the time axis (abscissa) is denoted by t/(sec) and the printing speed (ordinate) is denoted by V/(B/h). FIGS. 3, 4 and 5 graphically represent the variation of the printing speed V from the basic speed $V_G$ to a programmed value of the continuous printing speed $V_D$ as a function of time. In all three embodiments of the method, the conveyor table 2 between the feeder stack 13 and the feeder rest 3 is free of sheets at the beginning of start-up/restarting continuous printing. Following a printing stop or at the beginning of production, any sheets located between the feeder stack 13 and the feeder rest 3 are removed from the conveyor table 2 by an operator. At start-up/restart, the printing machine is run-up from the basic speed $V_G$ to the continuous printing speed $V_D$. Once the printing machine secures the continuous printing speed $V_D$, the first sheet reaches the predetermined position.

According to a preferred embodiment of the method, as shown in FIG. 3, at a time point g, the speed of the printing machine is run-up from the basic rotational speed $V_G$ to the production speed $V_D$, a higher rotational speed, which is reached at a time point d. The duration of the running-up operation is a time interval g-d, which is programmed and executed by the main drive of the printing machine. Based on the difference between the production speed $V_D$ and the basic rotational speed $V_G$, the slope of the programmed velocity ramp 30, and the number of sheets 6 between the feeder stack 13 and the feeder rest 3, it is possible to calculate the time point z at which the feeder assembly and sheet removal actuators are cut-in. This calculation is made by the controller 9 as is explained below.

In FIG. 3, the time for cutting-in both the feeder assembly and the sheet removal actuators occurs before the time point g when the printing machine is run-up according to the programmed run-up velocity ramp 30. According to the invention, the time point z is set such that the time point e at which the first sheet reaches the feeder rest is subsequent to or coincides with time point d, the time when the printing machine reaches the continuous production speed $V_D$.

FIG. 4 shows a second embodiment of the method according to the invention in which the continuous production speed $V_D$ is greater than the continuous production speed $V_D$ of FIG. 3. The slope of the velocity ramp 32 in FIG. 4, however, is identical to the slope of the velocity ramp 30 in FIG. 3. Therefore, the time interval g-d required for the printing machine to reach the continuous production speed in FIG. 4 is greater than the corresponding interval in FIG. 3. Consequently, as shown in FIG. 4, the cutting-in of the feeder unit and sheet removal acuators does not occur until after printing machine run-up is initiated.

In a similar way to the explanation given above, at a time point g, the speed of the printing machine is run-up from the basic rotational speed $V_G$ to the production speed $V_D$ which is reached at a time point d. At a time point z', both the feeder assembly and the sheet removal actuators are cut-in and sheets advance over the transport roller to the feeder rest at a speed of V'. Time point z' is set such that the time point e at which the first sheet reaches the feeder rest comes after or coincides with time point d when the printing machine reaches the continuous production speed $V_D$. The time interval z'-e between a first sheet reaching the feeder rest and the cutting-in of the feeder assembly and sheet removal actuators is smaller than the time interval z-e in FIG. 3. Both time intervals, however, require the same number of machine revolutions for conveying the first sheet from the feeder stack to the feeder rest. The smaller time interval z'-e occurs because the printing machine, including the feeder assembly and sheet feed, is running at a higher speed V'.

FIG. 5 shows a third embodiment of the method according to the invention in which the sheet removal actuators are cut-in at a time point z" at a printing speed V" above the maximum printing speed $V_M$ at which the feeder assembly can be cut-in mechanically. The feeder assembly is cut-in at a time point z' at a speed V' below the maximum printing speed $V_M$. Therefore, there is a time interval z'–z" between cutting-in the feeder assembly and cutting-in the sheet removal actuators.

In all three embodiments, time point e represents the time at which a first sheet arrives at the feeder rest. An object of the invention is that the first sheet reaches the predetermined position at the same time or after the production speed $V_D$ is reached. According to the method, it is possible to calculate the time to cut-in the feeder assembly and sheet removal actuators based on the number of machine revolutions n before or after the time point g, initiation of the run-up process from the basic speed $V_G$ to the production speed $V_D$.

The following is a derivation of the computations necessary to implement the method. For an acceleration b:

$$b=(V_M/3600)/t_{ramp},$$

where b represents the acceleration (1/sec$^2$) from $V_G$ to $V_D$ at a prescribed $t_{ramp}$ equal to the time (sec) required for the printing machine to accelerate from V=0 to $V=V_M$, the resultant acceleration time t (sec) is $$V_D/3600=V_G/3600+b\cdot t, \text{ or}$$

$$t=(V_D/3600-V_G/3600)/b$$

The number of machine revolutions n during the run-up process is determined from:

$$n=V_G/3600\cdot t+b/2\cdot t^2$$

Substituting for t as previously determined, n becomes:

$$n=[(V_D/3600)^2-(V_G/3600)^2]/2\cdot b$$

Finally, substituting with $b=(V_M/3600)/t_{ramp}$, n becomes:

$$n=[(V_D/3600)^2-(V_G/3600)^2]/2\cdot(t_{ramp}\cdot V_M/3600)$$

This value n thus specifies the number of machine revolutions which elapse in order to run-up the printing machine from the basic speed $V_G$ to the production speed $V_D$. For example, if the above equations yield n=8 revolutions, and there are six sheets between the feeder stack and the feeder rest requiring six revolutions for the first sheet to reach the feeder rest, it follows that the sheet removal actuators cut-in after two revolutions. Similarly, if the sheets must advance to the first printing zone, instead of the feeder rest, the same derivations are executed. Typically, 7.2 sheets reside between the feeder stack and the first printing zone. In this case, it follows that the sheet removal actuators cut-in at 0.8 revolutions after the run-up process begins.

Although the invention has been described in connection with certain embodiments, there is no intent to in any way limit the invention to those embodiments. On the contrary, the intent is to cover all alternatives, modifications, and equivalents included within the spirit and scope of the invention as defined by the appended claims.

I claim:

1. A method for starting-up/restarting continuous printing in a sheet-processing printing machine, wherein sheets to be printed are fed from a stack to a printing unit through a feeder assembly including a sheet feed and separately actuable members causing removal of the sheets from the stack, the feeder assembly being selectively coupled to the printing unit through a switchable coupling, the method comprising the steps of: cutting-in the feeder assembly at a basic rotational speed through a switchable coupling; cutting-in the actuable members causing removal of the sheets from the stack to cause the sheets to be conveyed to a predetermined position inside the printing machine; and running-up the coupled printing unit to a predetermined continuous printing speed from the basic rotational speed such that the time for starting the running-up of the printing unit is set as a function of the number of machine revolutions necessary to convey a first sheet from the stack to the predetermined position inside the printing unit so that the first sheet reaches the predetermined position after or at the same time the continuous printing speed is reached.

2. The method for starting-up/restarting continuous printing in the sheet-processing printing machine according to claim 1, wherein the predetermined position inside the printing unit is a feeder rest of a first printing unit of the sheet-processing printing machine.

3. The method for starting-up/restarting continuous printing in the sheet-processing printing machine according to claim 1, wherein the step of cutting-in the feeder assembly occurs simultaneously with the step of cutting-in the actuable members causing removal of sheets from the stack.

4. The method for starting-up/restarting continuous printing in the sheet-processing printing machine according to claim 1, wherein the step of running-up the coupled printing unit to the predetermined continuous printing speed occurs prior to the steps of cutting-in the feeder assembly and cutting-in the actuable members, the steps of cutting-in the feeder assembly and cutting-in the members occur consecutively.

5. The method for starting-up/restarting continuous printing in the sheet-processing printing machine according to claim 1, wherein the step of running-up the coupled printing unit to the predetermined continuous printing speed occurs prior to the steps of cutting-in the feeder assembly and cutting-in the actuable members, the steps of cutting-in the feeder assembly and cutting-in the members occur simultaneously.

* * * * *